US011692675B2

(12) United States Patent
Van Bommel et al.

(10) Patent No.: US 11,692,675 B2
(45) Date of Patent: Jul. 4, 2023

(54) COLOR TEMPERATURE CONTROLLABLE LIGHTING DEVICE COMPRISING DIFFERENT LED FILAMENTS

(71) Applicant: SIGNIFY HOLDING B.V., Eindhoven (NL)

(72) Inventors: Ties Van Bommel, Horst (NL); Rifat Ata Mustafa Hikmet, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 13 days.

(21) Appl. No.: 17/622,440

(22) PCT Filed: Jun. 22, 2020

(86) PCT No.: PCT/EP2020/067344
§ 371 (c)(1),
(2) Date: Dec. 23, 2021

(87) PCT Pub. No.: WO2020/260197
PCT Pub. Date: Dec. 30, 2020

(65) Prior Publication Data

US 2022/0356995 A1 Nov. 10, 2022

(30) Foreign Application Priority Data

Jun. 24, 2019 (EP) ..... 19181977

(51) Int. Cl.
*F21K 9/232* (2016.01)
*F21Y 115/10* (2016.01)

(52) U.S. Cl.
CPC ..... *F21K 9/232* (2016.08); *F21Y 2115/10* (2016.08)

(58) Field of Classification Search
CPC ..... F21K 9/232; F21Y 2115/10
See application file for complete search history.

(56) References Cited

U.S. PATENT DOCUMENTS

| | | | | |
|---|---|---|---|---|
| 2017/0038010 | A1 | 2/2017 | Rao et al. | |
| 2017/0130906 | A1* | 5/2017 | Jiang | H01L 33/62 |
| 2017/0227169 | A1* | 8/2017 | Jiang | F21V 3/02 |
| 2018/0080611 | A1* | 3/2018 | Haberkorn | F21K 9/232 |

(Continued)

FOREIGN PATENT DOCUMENTS

| | | | |
|---|---|---|---|
| CN | 203656627 | U | 6/2014 |
| CN | 204187337 | U | 3/2015 |
| CN | 205746175 | U | 11/2016 |

(Continued)

*Primary Examiner* — Evan P Dzierzynski

(57) ABSTRACT

The present disclosure relates to a lighting device. The lighting device (100) comprises a first elongated light-emitting diode, LED, filament (110) and a second elongated LED filament (120). The lighting device further comprises an at least partially light-transmissive envelope (130), which at least partially envelops at least the first LED filament and the second LED filament, and a base (140) on which the at least partly light-transmissive envelope is mounted. The first LED filament is configured to emit light with a different color temperature than the second LED filament. Further, the second LED filament is at least partially curved such that it defines at least part of a contour of a volume (421). The first LED filament is arranged at least partially within the volume.

11 Claims, 4 Drawing Sheets

(56) References Cited

U.S. PATENT DOCUMENTS

2018/0328543 A1 11/2018 Bergmann et al.

FOREIGN PATENT DOCUMENTS

| | | | |
|---|---|---|---|
| CN | 206176271 | U | 5/2017 |
| CN | 107975689 | A | 5/2018 |
| CN | 108916677 | A | 11/2018 |
| WO | 2019015763 | A1 | 1/2019 |

* cited by examiner

COLOR TEMPERATURE CONTROLLABLE LIGHTING DEVICE COMPRISING DIFFERENT LED FILAMENTS

CROSS-REFERENCE TO PRIOR APPLICATIONS

This application is the U.S. National Phase application under 35 U.S.C. § 371 of International Application No. PCT/EP2020/067344, filed on Jun. 22, 2020, which claims the benefit of European Patent Application No. 19181977.0, filed on Jun. 24, 2019. These applications are hereby incorporated by reference herein.

TECHNICAL FIELD

The present disclosure relates generally to the field of solid state lighting. More specifically, it relates to a lighting device providing color temperature control.

BACKGROUND

Incandescent lamps are rapidly being replaced by light-emitting diode (LED) based lighting solutions. Solid state lighting devices may provide many advantages over their incandescent, fluorescent, and gas-discharge based counterparts. For instance, they may provide increased operational life, reduced power consumption and higher efficacy. Solid state lighting devices, such as LEDs, are employed in a wide range of lighting applications including general lighting.

LED based lighting has been developed as retrofit lamps to provide a look and light similar to that of an incandescent bulb. However, further development is required in order to provide improved and more decorative LED based lighting devices.

US 2018/328543 discloses a lamp that includes an optically transmissive enclosure for emitting an emitted light and a base connected to the enclosure. At least one first LED filament and at least one second LED filament are located in the enclosure and are operable to emit light when energized through an electrical path from the base. The first LED filament emits light having a first correlated color temperature (CCT) and the second LED filament emits light having a second CCT that are combined to generate the emitted light. A controller operates to change the CCT of the emitted light when the lamp is dimmed

SUMMARY

One general aim of the present disclosure is to provide color controllable LED filament lamps. Specifically, there is a desire to be able to control the color temperature of white light LED filament lamps. Adjusting the color temperature of the light may transform the atmosphere of a room. Further, as many people spend a large part of their day indoors, both at home and at work, the effect of different lighting on circadian rhythm and sleeping patterns may become more noticeable. Being able to adjust lighting color temperature during the course of the day may be beneficial both for improved efficiency at work and to maintain healthier sleeping patterns.

Within the context of the present invention a LED filament is providing LED filament light and comprises a plurality of light emitting diodes (LEDs) arranged in a linear array. Preferably, the LED filament has a length L and a width W, wherein L>5W. The LED filament may be arranged in a straight configuration or in a non-straight configuration such as for example a curved configuration, a 2D/3D spiral or a helix. Preferably, the LEDs are arranged on an elongated carrier like for instance a substrate, that may be rigid (made from e.g. a polymer, glass, quartz, metal or sapphire) or flexible (e.g. made of a polymer or metal e.g. a film or foil).

In case the carrier comprises a first major surface and an opposite second major surface, the LEDs are arranged on at least one of these surfaces. The carrier may be reflective or light transmissive, such as translucent and preferably transparent.

The LED filament may comprise an encapsulant at least partly covering at least part of the plurality of LEDs. The encapsulant may also at least partly cover at least one of the first major or second major surface. The encapsulant may be a polymer material which may be flexible such as for example a silicone. Further, the LEDs may be arranged for emitting LED light e.g. of different colors or spectrums. The encapsulant may comprise a luminescent material that is configured to at least partly convert LED light into converted light. The luminescent material may be a phosphor such as an inorganic phosphor and/or quantum dots or rods. The LED filament may comprise multiple sub-filaments.

It is therefore an object of the present invention to provide an improved lighting device providing color control. This and other objects are achieved by means of a lighting device as defined in the appended independent claim. Other embodiments are defined by the dependent claims.

According to embodiments of the present disclosure, a lighting device is provided. The lighting device comprises a first elongated light emitting diode (LED) filament, and a second elongated LED filament. The lighting device further comprises an at least partially light-transmissive envelope, which at least partially envelops the first LED filament and the second LED filament. The at least partially light-transmissive envelope is mounted on a base. The first LED filament is configured to emit light with a color temperature which is different from the color temperature of the light emitted by the second LED. The second LED filament is at least partially curved so that it defines at least part of a contour of a volume. The first LED filament is arranged at least partially within the volume defined by the second LED filament.

The second LED filament is curved (or bent) in a way that it defines at least part of an outline (or contour) of a shape (or volume). In particular, the second LED filament may be curved to define at least part of a contour of a three-dimensional shape/volume such that a space is formed within the contour defined by the second LED filament.

The volume may for example be a geometric figure, such as a cylinder, a parallelepiped, a cone or a sphere. The volume may be an irregular figure.

An issue which may arise when placing two LED filaments with different light-emission close to one another is cross-talk. In the field of LED filament lighting, cross-talk may refer to the situation when light from one LED filament is absorbed by another LED filament, and sometimes re-emitted at a different wavelength. This may lead to a color point shift in the light emitted by the lighting device, which may in turn lead to a shift in the color temperature and the color rendering index (CRI) of the lighting device. Color rendering index is a measure of how well a light source displays the color of an object in comparison with an ideal light source.

As the second LED filament is at least partially curved, at least portions of the second LED filament may extend in a direction which is different from the extension of the first LED filament. In other words, at least portions of the second LED filament may have a different orientation than the first LED filament. Arranging the LED filaments with different orientations (extending in different directions) may lower the effect of cross-talk between the filaments.

Further, as the first LED filament is arranged at least partially within the volume defined (at least partly) by the second LED filament, instead of for example being arranged parallel to the second LED filament, the distance between the LED filaments with different color temperature may be larger. A larger distance between (at least parts of) the LED filaments may further decrease any cross-talk effect.

According to some embodiments, the first LED filament may be adapted to emit light with a higher color temperature than the second LED filament.

Whiteness of light sources is often described in relation to ideal black body radiators. When the temperature of an ideal black body increases, the body starts glowing red, i.e. emitting red light. As it heats up, the light turns yellow, and finally, for very high temperatures, the emitted light becomes white. The correlated color temperature (CCT) of a light source is the temperature (expressed in kelvin) of an ideal black body radiator showing the most similar color. The black body line, or black body locus (BBL) is the path that such a black body would take in a particular chromaticity space as its temperature increases.

In a sense, the everyday notion of color temperature is opposite to the CCT scale. Usually, a redder light is described to be warm, while a white-blue light is described as cold. In the CCT scale, a red (warm) light corresponds to a lower (colder) temperature, while a white-blue (cold) light corresponds to a higher (warmer) temperature.

According to some embodiments, the first LED filament may be configured to emit light with a CCT which is higher than 2700 K.

Light with a CCT higher than 2700 K may provide a better visibility of objects. Including light above 2700 K may allow for the lighting device to be used for general lighting in places where activities which require high visibility are performed, such as work places. Such activities may for example include reading and cleaning.

More specifically, the first LED filament may be configured to emit light with a CCT which is higher than 2900 K. Even more specifically, the first LED filament may be configured to emit light with a CCT which is higher than 3000 K.

According to some embodiments, the second LED filament may be configured to emit light with a CCT which is lower than 2500 K.

Light with a CCT lower than 2500 K is classified as warm white. Such light may provide a pleasant atmosphere.

More specifically, the second LED filament may be configured to emit light with a CCT which is lower than 2400 K. Even more specifically, the second LED filament may be configured to emit light with a CCT which is lower than 2300 K.

In embodiments which include one LED filament in a higher color temperature range, and one LED filament in a lower color temperature range, the same lighting device may be used for different activities. For example, a lighting device used in a kitchen may be used both for cleaning the kitchen (high CCT providing good visibility) and when having dinner (lower CCT giving a pleasant atmosphere). This may provide a user with the option of adapting the lighting to the present activity and mood.

According to some embodiments, the first LED filament may be shorter than the second LED filament.

In embodiments in which the first LED filament is shorter, a larger portion of the first LED filament may be arranged within the volume defined (at least in part) by the second LED filament. The second LED filament surrounding a larger portion of the first LED filament may lead to more homogeneous illumination.

Thus, in embodiments in which the first LED filament has a higher color temperature, the first LED filament may be shorter than the second LED filament (with lower CCT), and still provide similar illumination properties.

According to some embodiments, the first LED filament may have a first LED filament length, and the second LED filament may have a second LED filament length. The second LED filament length may be more than twice as long as the first LED filament length.

A longer second LED filament may be arranged with larger portions extending in different directions than the first LED filament. Increasing the contrast in length may thus increase the difference in the orientation of portions of the first LED filament and portions of the second LED filament, which may further reduce the effects of cross talk while at the same time giving the lighting device a more pleasant appearance. Further, a longer second LED filament may define a larger volume in which the first LED filament may be arranged. A larger volume may allow an increased distance between the first LED filament and the second LED filament, which may in turn further decrease the effects of cross-talk.

For example, the second LED filament length may be more than three times as long as the first LED filament length. Specifically, the second LED filament length may be more than four times as long as the first LED filament length. More specifically the second LED filament length may be five times as long as the first LED filament length, or seven times as long as the first LED filament length.

According to some embodiments, the first LED filament may have a larger diameter than said second LED filament.

A LED filament with a larger diameter may for example comprise more LEDs than a LED filament with a smaller diameter. Thus, a first LED filament with a larger diameter may be shorter and still provide a similar flux as the second LED filament.

According to some embodiments, the first LED filament may have a first LED filament diameter and the second LED filament may have a second LED filament diameter. The first LED filament diameter may be more than twice as large as the second LED filament diameter.

A larger diameter of a LED filament may entail that a larger number of LEDs may be included in the filament. A higher contrast in diameter may for example allow a larger contrast in length between the first LED filament and the second LED filament, which may in turn increase the reduction of cross-talk. It will be appreciated that a larger contrast in diameter may further provide the lighting device a more pleasant appearance.

For example, the first LED filament diameter may be more than three times as large as the second LED filament diameter. Specifically, the first LED filament diameter may be more than four times as large as the second LED filament diameter. More specifically, the first LED filament diameter may be five times as large as the second LED filament diameter, or seven times as large as the second LED filament diameter.

According to some embodiments, the first LED filament may be arranged along a central axis of the volume defined at least partly by the second LED filament.

A central axis of the volume defined (at least partly) by the second LED filament may be a straight line for which the average distance to the second LED filament is maximized. Arranging the first LED filament along the central axis may maximize the distance between the two LED filaments, and thus minimize the effects of cross-talk between the filaments. Further, arranging the first LED filament along such a central axis may lead to a more homogeneous spread of light from the lighting device.

According to some embodiments, the first LED filament may be substantially straight, or less curved than the second LED filament.

"Less curved" may mean more straight, that is more similar to a straight line. A less curved LED filament of a defined length may extend a longer distance than a more curved LED filament of the same length. For example, a helix with a significantly larger pitch (distance between successive turns) may be referred to as less curved than a helix with a smaller pitch.

According to some embodiments, the second LED filament may form a helix shape.

A helix shaped second LED filament may provide increased uniformity of the combined light. Further, in embodiments in which the second LED filament forms a helix shape (spiral, coil), major portions of the second LED filament may be oriented differently from the first LED filament. Different orientations of the LED filaments may decrease the effects of cross-talk between the filaments.

As an example, the helix shape may form at least three full turns around the helix (central) axis, or around the (straight) first LED filament.

According to some embodiments, the lighting device may further comprise a controller. The controller may be configured to control a power supply to the first LED filament and a power supply to the second LED filament.

The controller may control the power (or current) supply to the LED filaments individually, in order to control the respective light-emission of the different LED filaments. Varying the ratio of emission of two LED filaments with different color temperatures, the correlated color temperature (CCT) of the combined light, the light emitted by the lighting device, may be changed. Specifically, the range of CCT control may be defined by the CCT of the LED filament with the lowest color temperature and the CCT of the LED filament with the highest color temperature.

In other words, the controller may be adapted to control the power supply (or current supply) to the first LED filament and to the second LED filament to vary the CCT of the light emitted by the lighting device.

Further, control of the power (or current) supply to the LED filaments may also control the flux of the light emitted by the lighting device. The controller may be adapted to control both the CCT of the combined light, and the intensity or flux of the combined light.

Varying the ratio of emission between the first LED filament and the second LED filament may allow for the color temperature of the combined light (i.e. the light emitted by the lighting device) to move in a range along a line close to the black body line (BBL) between the CCT of the first LED filament light and the CCT of the second LED filament light. This means that the LED filament may act similar to an ideal black body radiator within the range.

According to some embodiments, the first LED filament and the second LED filament may comprise LEDs configured to emit light with a peak wavelength in the ultra violet range 365-380 nm (UV LEDs). The first LED filament and the second LED filament may further comprise LEDs configured to emit light with a peak wavelength in the blue range 435-500 nm (blue LEDs).

Blue LEDs and UV LEDs are efficient and may be combined with different phosphors (wavelength converting materials) to create white light with different CCTs. The LED filaments may each comprise UV LEDs or blue LEDs or both kinds of LEDs. The first LED filament may comprise the same type (or types) of LEDs as the second LED filament. Alternatively, the first LED filament may comprise different types of LEDs than the second LED filament.

Alternatively, the first LED filament and/or the second LED filament may comprise RGB LEDs instead of blue and/or UV LEDs. RGB LEDs comprise a red, a green and a blue LED within the same package. The combination of light emitted by the three LEDs may form white light.

According to some embodiments, the first LED filament may comprise a first substrate and a first encapsulant. The first substrate may have a first side on which a first plurality of LEDs may be arranged. The first encapsulant may encapsulate at least part of the first side of the first substrate and the first plurality of LEDs. Similarly, the second LED filament may comprise a second substrate and a second encapsulant. The second substrate may have a first side on which a second plurality of LEDs may be arranged. The second encapsulant may encapsulate at least part of the first side of the second substrate and the second plurality of LEDs.

Such encapsulants may provide a protective cover for the LEDs and the substrate. Further, the encapsulants may aid in scattering (i.e. redirecting, refracting) the light. Scattering/refraction may be caused by the encapsulant comprising a scattering material, or scattering particles.

According to some embodiments, the first encapsulant may comprise a first wavelength converting material. Further, the second encapsulant may comprise a second wavelength converting material.

Alternatively, one or both encapsulants may comprise no wavelength converting material. Specifically, the first encapsulant may comprise a first wavelength converting material, while the second encapsulant does not comprise any wavelength converting material. Alternatively, the first encapsulant may comprise no wavelength converting material, while the second encapsulant comprises a second wavelength converting material.

A wavelength converting material is a material which absorbs energy from electromagnetic radiation (e.g. visible light) at a certain range of wavelengths, and releases energy as radiation at a different (possibly overlapping) range of wavelengths.

One or both of the wavelength converting materials may comprise a green/yellow phosphor. The green/yellow phosphor may convert at least some light emitted by the LEDs to green/yellow light.

One or both of the wavelength converting materials may comprise a red phosphor. The red phosphor may convert some of the light emitted by the LEDs arranged on the substrate to red light.

The type of LEDs together with the type and amount of wavelength converting material may contribute in providing the LED filament its color temperature. The light provided by the lighting device may be a combination of LED light (i.e. light emitted by the LEDs, unconverted light) and converted light (i.e. light emitted by the LEDs, absorbed by a wavelength converting material, and emitted with a different wavelength). As the LED filaments may comprise different types of LEDs and different types of wavelength converting materials, there may be many components making up the combined light (lighting device light).

Further, in some embodiments, the first and/or the second encapsulant may comprise light scattering material. Specifically, in embodiments in which an encapsulant (first and/or second) does not comprise any wavelength converting material, that encapsulant may comprise light scattering material. Light scattering material may, for example, comprise barium sulfate ($BaSO_4$), aluminum oxide ($Al_2O_3$), and/or titanium dioxide ($TiO_2$) particles.

It is noted that other embodiments using all possible combinations of features recited in the above described embodiments may be envisaged. Thus, the present disclosure also relates to all possible combinations of features mentioned herein. Any embodiment described herein may be combinable with other embodiments also described herein, and the present disclosure relates to all combinations of features.

DESCRIPTION OF THE DRAWINGS

Exemplifying embodiments will now be described in more detail, with reference to the following appended drawings.

As illustrated in the figures, the sizes of the elements and regions may be exaggerated for illustrative purposes and, thus, are provided to illustrate the general structures of the embodiments. Like reference numerals refer to like elements throughout.

DETAILED DESCRIPTION

Exemplifying embodiments will now be described more fully hereinafter with reference to the accompanying drawings, in which currently preferred embodiments are shown. The invention may, however, be embodied in many different forms and should not be construed as limited to the embodiments set forth herein; rather, these embodiments are provided for thoroughness and completeness, and fully convey the scope of the invention to the skilled person.

Figure 1:
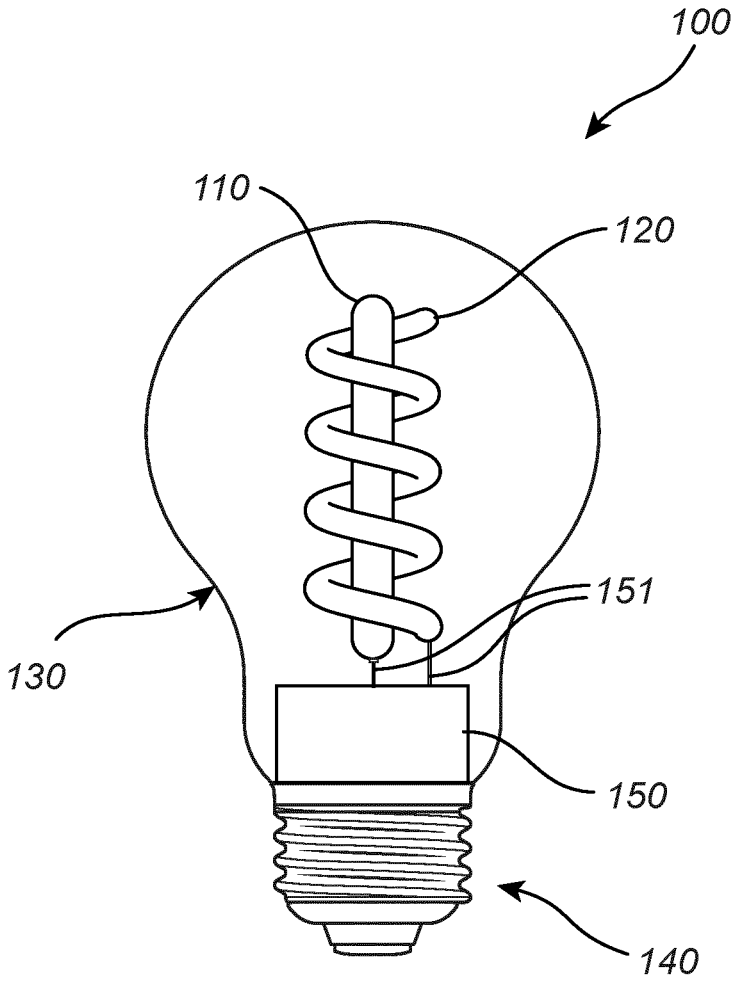
FIG. 1 is a schematic illustration of a lighting device, in accordance with some embodiments.

With reference to FIG. 1 a lighting device in accordance with some embodiments of the present disclosure will be described.

FIG. 1 is a schematic illustration of a lighting device 100 comprising a first elongated LED filament 110, a second elongated LED filament 120, an at least partially light-transmissive envelope 130, a base 140, a controller 150 and connectors 151.

In the present embodiment, the second LED filament 120 is curved to form a helix shape, which defines part of the contour of a cylindrical volume. In other embodiments, the volume may have other shapes. The first LED filament 110 is substantially straight, and is arranged within the cylindrical volume. The first LED filament extends along the elongation of the cylindrical volume, i.e. in a direction from one circular end of the cylindrical volume towards the opposite circular end of the cylindrical volume.

The first and second LED filaments 110, 120 are connected to the controller 150 by means of connectors 151. Connectors 151 may comprise holding means for holding the first and second LED filaments 110, 120. Connectors 151 may comprise electrical connectors for supplying power to the first and second LED filaments 110, 120.

In some embodiments, the first LED filament 110 and/or the second LED filament may be rigid. In some embodiments, the first LED filament 110 and/or the second LED filament 120 may be flexible. In certain embodiments, the first LED filament 110 may be rigid, while the second LED filament 120 may be flexible.

The envelope 130 envelops the first and second LED filaments 110, 120. The envelope 130 is mounted on the base 140. The base 140 may comprise electrical connectors for connecting the lighting device 100 to a luminaire socket. The base 140 may be adapted to be connected with for example an Edison socket or a bayonet socket. The base 140 may for example comprise a cap, such as an E27 cap. The base 140 may further comprise a housing. In some embodiments, the controller 150 may be arranged within the housing.

The first LED filament 110 is configured to emit light with a different color temperature than the second LED filament 120. For example, the first LED filament 110 may be configured to emit light with a higher color temperature than the second LED filament 120. For example, the first LED filament 110 may emit light with a correlated color temperature higher than 2700 K. Specifically, the LED filament 110 may be configured to emit light with a CCT which is higher than 2900 K. More specifically, the first LED filament 110 may be configured to emit light with a CCT higher than 3000 K.

The second LED filament 120 may for example be configured to emit light with a CCT which is lower than 2500 K. Specifically, the second LED filament 120 may be configured to emit light with a CCT lower than 2400 K. More specifically, the second LED filament 120 may be configured to emit light with a CCT lower than 2300 K.

Light emitted by the two LED filaments 110, 120 is mixed/combined to form the light emitted by the lighting device 100. The envelope 130 is at least partially light-transmissive to couple out the light emitted by the first and second LED filaments 110, 120, i.e. to transmit light outside the envelope 130. The envelope 130 has a reflectivity for wavelengths emitted by the LED filaments 110, 120 which may be less than 20%. Specifically, the reflectivity of the envelope 130 for wavelengths emitted by the LED filaments 110, 120 may be less than 15%. More specifically, the reflectivity of the envelope 130 for wavelengths emitted by the LED filaments 110, 120 may be less than 10%. For example, the envelope may be transparent.

The controller 150 may be configured to control the power supply to the first LED filament 110 and the second LED filament 120 individually. Through control of the power supply of the LED filaments 110, 120, the brightness of each one of the LED filaments 110, 120 may be controlled.

The ratio of power between the first LED filament 110 and the second LED filament 120 is of particular interest, as a change in the ratio of emittance between the two LED filaments 110, 120 may change the color temperature of the combined light. The controller 150 may control the color temperature of the light emitted by the lighting device 100 in a range extending from the CCT of the first LED filament 110 (no power supplied to the second LED filament) to the CCT of the second LED filament 120 (no power supplied to the first LED filament).

Figure 2:
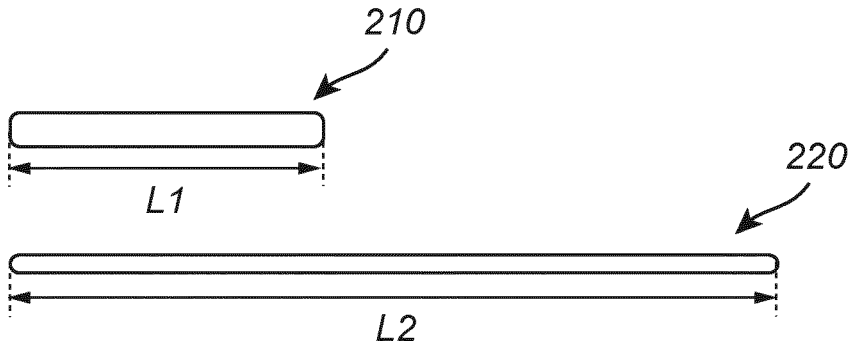
FIG. 2 shows schematic views of an extended first LED filament and an extended second LED filament in accordance with some embodiments.

With reference to FIG. 2, the respective lengths of the first LED filament and the second LED filament, in accordance with some embodiments, will be discussed (or compared).

FIG. 2 shows a schematic view of a first LED filament 210, and a second LED filament 220. The first LED filament 210 and the second LED filament 220 may be equivalent to the first LED filament 110 and the second LED filament 120 described with reference to FIG. 1, except that both filaments have been extended to be straight so that their respective lengths may be compared. However, when arranged in a lighting device, such as the lighting device 100 described with reference to FIG. 1, at least the second LED filament 220 (and possibly both LED filaments) may be at least partially curved.

The first LED filament 210 is shorter than the second LED filament 220, when they are both stretched out, i.e. not curved (or straight). The first LED filament 210 has a first LED filament length L1. The second LED filament 220 has a second LED filament length L2. For example, the second LED filament length L2 may be at least twice as long as the first LED filament length L1 (L2>2L1). Specifically, the second LED filament length L2 may be three times as long as the first LED filament length L1 (L2>3L1). More specifically, the second LED filament length L2 may be more than four times as long as the first LED filament length L1 (L2>4L1), such as five times as long (L2=5L1) or seven times as long (L2=7L1).

In some embodiments, the first LED filament length L1 may be shorter than 8 cm. Specifically, the first LED filament length L1 may be shorter than 6 cm. More specifically, the first LED filament length L1 may be shorter than 5 cm.

In some embodiments, the second LED filament length L2 may be longer than 10 cm. Specifically, the second LED filament length L2 may be longer than 12 cm. More specifically, the second LED filament length LED may be longer than 15 cm.

Figure 3:
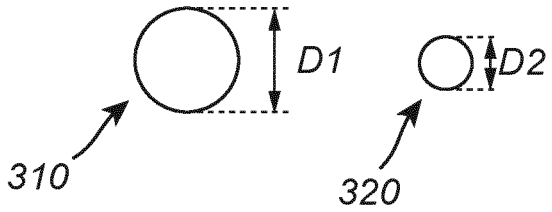
FIG. 3 shows cross sections of a first LED filament and a second LED filament in accordance with some embodiments.

With reference to FIG. 3, the respective diameters of the LED filaments, in accordance with some embodiments, will be discussed (or compared).

FIG. 3 shows cross sections of the first LED filament 310 and of the second LED filament 320. The first LED filament 310 and the second LED filament 320 may be equivalent to the first LED filament 110 or 210 and the second LED filament 120 or 220 described with reference to FIG. 1 or FIG. 2, respectively.

The first LED filament 310 has a larger diameter than the second LED filament 320. Specifically, the first LED filament 310 has a first LED filament diameter D1 and the second LED filament has a second LED filament diameter D2. The first LED filament diameter D1 may for example be twice as large as the second LED filament diameter D2 (D1>2D2). Specifically, the first LED filament diameter D1 may be three times as large as the second LED filament diameter D2 (D>3D2). More specifically the first LED filament diameter D1 may be four times as large as the second LED filament diameter D2 (D1>4D2), such as for example five times as large (D=5D2) or seven times as large (D1=7D2).

In some embodiments, the first LED filament diameter D1 may be larger than 7 mm. Specifically, the first LED filament diameter D1 may be larger than 9 mm. More specifically, the first LED filament diameter D1 may be larger than 10 mm.

In some embodiments, the second LED filament diameter D2 may be smaller than 7 mm. Specifically, the second LED filament diameter D2 may be smaller than 6 mm. More specifically, the second LED filament diameter D2 may be smaller than 5 mm.

Figure 4:
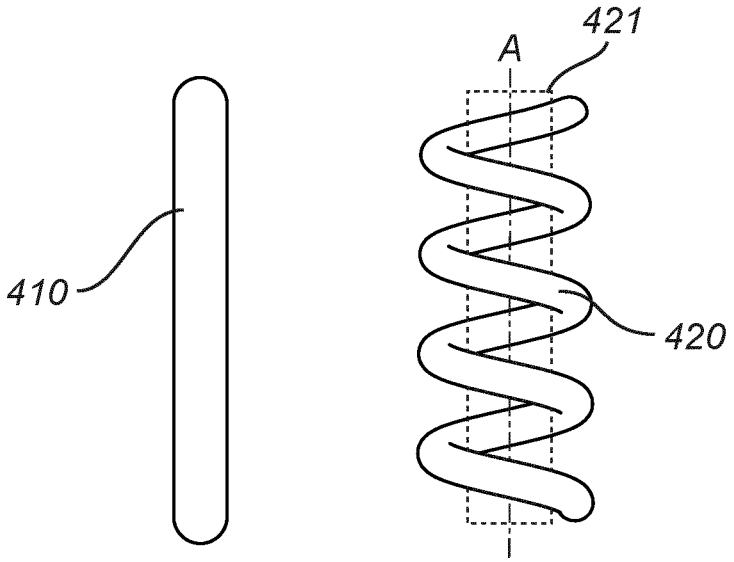
FIG. 4 is an illustration of a first LED filament and a second LED filament in accordance with some embodiments.

With reference to FIG. 4, the curvature of the LED filaments, in accordance with some embodiments, will be discussed (or compared).

FIG. 4 is an illustration of a first LED filament 410 and a second LED filament 420. The first and second LED filaments 410, 420 may be equivalent to their counterparts described with reference to the previous figures.

The first LED filament 410 is less curved than the second LED filament 420. Specifically, the first LED filament 410 is substantially straight. The second LED filament 420 is longer than the first LED filament 410 and the second LED filament 420 is arranged to form a helix shape. The helix shape defines part of a contour of a cylindrical volume 421. The helix shape has a central axis A. When arranged in a lighting device, such as the lighting device 100 described above with reference to FIG. 1, the first LED filament 410 may be arranged at least partially within the volume or space 421. More specifically, the first LED filament 410 may be arranged along the central axis A.

The helix shape of the second LED filament 420 is one option among others. The second LED filament 420 may be at least partially curved to define (at least part of the contour of) any other volume in which the first LED filament 410 may be at least partially arranged. For example, the second LED filament 420 may have a curved shape defining part of a contour of a spherical volume, a conical volume etc.

Figure 5:
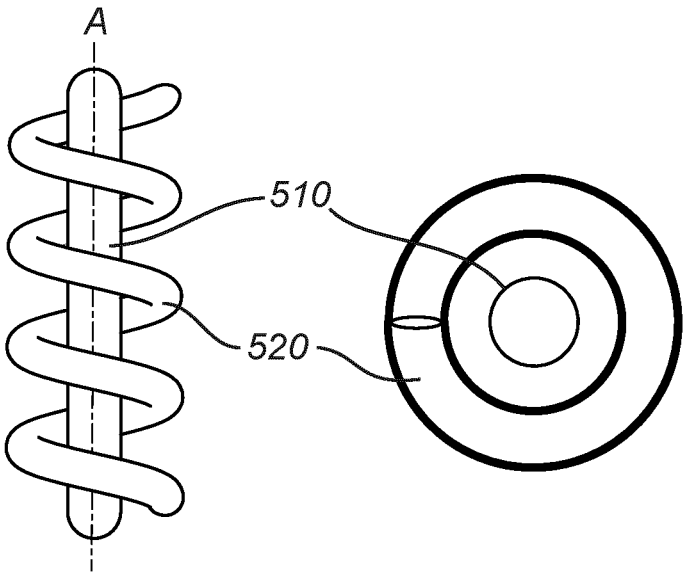
FIG. 5 is an illustration of a first LED filament arranged along a central axis of a volume defined by a second LED filament, in accordance with some embodiments.

With reference to FIG. 5, an arrangement of LED filaments in accordance with some embodiments will be described.

FIG. 5 shows two different views of an arrangement of a first LED filament 510 and a second LED filament 520 in accordance with some embodiments: one side view and one view along the central axis A (top view).

The first LED filament 510 is substantially straight, and may be equivalent to any of the first LED filaments 110-410, described with reference to FIGS. 1-4. The second LED filament 520 forms a helix (spiral, coil) shape, and may be equivalent to any of the second LED filaments 120-420 described with reference to the FIGS. 1-4.

The first LED filament 510 is arranged along the central axis A of the helical shape formed by the second LED filament 520.

Figure 6:
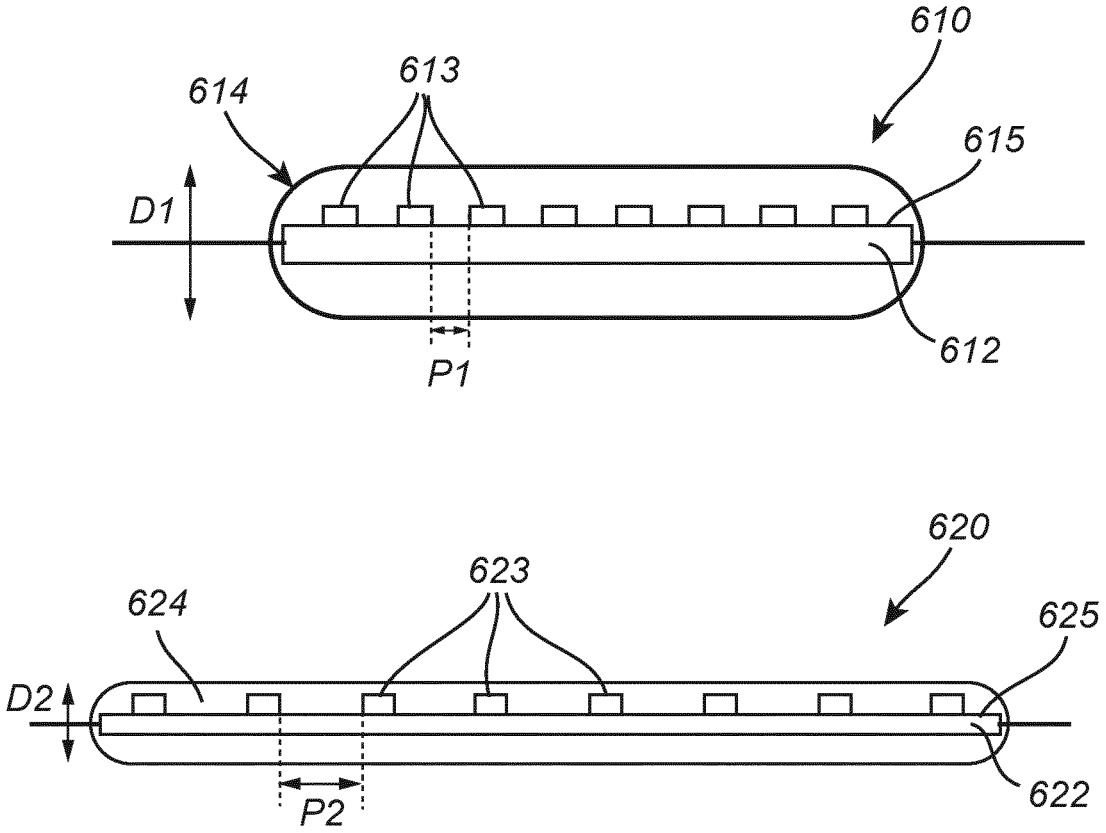
FIG. 6 illustrates lengthwise cross sections of an extended first LED filament and an extended second LED filament, in accordance with some embodiments.

With reference to FIG. 6, the structure of the first and second LED filaments will be described.

FIG. 6 shows a cross section of a first LED filament 610 and a cross section of a second LED filament 620, in accordance with some embodiments. For illustrative purposes, both LED filaments are shown as straight, however, as may be understood by the rest of the description and the claims, at least the second LED filament (and possibly both LED filaments) may be at least partially curved when arranged in a lighting device.

The first LED filament 610 comprises a first substrate 612 having a first side 615. On the first side 615, a first plurality of LEDs 613 is arranged. A first encapsulant 614 encapsulates at least part of the first side 615 and the plurality of LEDs 613. The second LED filament 620 comprises a second substrate 622 having a first side 625. A second plurality of LEDs 623 is arranged on the first side 625. A second encapsulant 624 encapsulates at least part of the first side 625 and the plurality of LEDs 623.

Each of the substrates 612, 622 may be light-transmissive. Specifically, the substrates 612, 622 may be transparent.

The first substrate 612 may be a rigid substrate. The second substrate 622 may be a flexible substrate, such that it may be curved. For example, the second substrate 622 may be a foil.

The first plurality of LEDs 613 may be arranged in one or more linear arrays on the first side 615 of the substrate 612. The LED pitch P1 (i.e. distance between successive LEDs) may be constant along the length of the LED filament 610, or vary. The first plurality of LEDs 613 may comprise LEDs which are configured to emit ultraviolet light, i.e. with a wavelength peak in the ultraviolet range 365-380 nm. The first plurality of LEDs 613 may comprise LEDs which are configured to emit blue light, i.e. with a peak wavelength in the range 435-500 nm. The first plurality of LEDs 613 may comprise one type of LEDs or more than one type of LEDs, such as blue LEDs and/or UV LEDs.

The second plurality of LEDs 623 may be arranged in one or more linear arrays on the first side 625 of the substrate 622. The LED pitch P2 may be constant along the length of the LED filament 620, or vary. The second plurality of LEDs 623 may comprise LEDs which are configured to emit ultraviolet light, i.e. with a wavelength peak in the ultraviolet range 365-380 nm. The second plurality of LEDs 623 may comprise LEDs which are configured to emit blue light, i.e. with a peak wavelength in the range 435-500 nm. The second plurality of LEDs 623 may comprise one type of LEDs or more than one type of LEDs, such as blue LEDs and/or UV LEDs.

The first LED filament 610 (i.e. the first plurality of LEDs 613) may comprise the same kinds/types of LEDs as the second LED filament 620 (the second plurality of LEDs 623). Alternatively, the first LED filament 610 and the second LED filament 620 may comprise different kinds of LEDs. For example, one of the LED filaments 610, 620 may comprise one type of LEDs, and the second one of the LED filaments 610, 620 may comprise the same type of LEDs and some other type of LEDs.

The first encapsulant 614 may comprise a silicone material. The first encapsulant 614 may encapsulate the first side 615 and the plurality of LEDs 613. In the present embodiment, the encapsulant 614 encapsulates the entire substrate 612 (i.e. all sides of the substrate 612) and the full plurality of LEDs 613.

The first encapsulant 614 may comprise a first wavelength converting material, configured to absorb at least some light emitted by the plurality of LEDs 613, and to emit light with a different peak wavelength. Such a wavelength converting material may comprise a luminescent material. For example, the wavelength converting material may comprise a red phosphor, for converting light emitted by the LEDs 613 to red light. Alternatively, or additionally, the first wavelength converting material may comprise a green/yellow phosphor, for providing green/yellow converted light.

The second encapsulant 624 may comprise a silicone material. The second encapsulant 624 may encapsulate the first side 625 of the second substrate 622 and the plurality of LEDs 623. In the present embodiment, the encapsulant 624 encapsulates the entire substrate 622 (i.e. all sides of the substrate 622) and the full plurality of LEDs 623.

The encapsulant 624 may comprise a second wavelength converting material, configured to absorb at least some light emitted by the plurality of LEDs 623, and to emit light at a different peak wavelength, i.e. with a different color. Such a wavelength converting material may comprise a luminescent material. For example, the wavelength converting material may comprise a red phosphor, for converting light emitted by the LEDs 623 to red light. Alternatively, or additionally, the second wavelength converting material may comprise a green/yellow phosphor, for providing green/yellow converted light.

Further, the first and/or the second encapsulant 614,624 may comprise light scattering material. Specifically, in embodiments in which an encapsulant (first 614 and/or second 624) does not comprise any wavelength converting material, that encapsulant 614, 624 may comprise light scattering material. Light scattering material may, for example, comprise barium sulfate ($BaSO_4$), aluminum oxide ($Al_2O_3$), and/or titanium dioxide ($TiO_2$) particles.

In other embodiments, the first LED filament 610 may comprise a second side which is opposite to the first side 615. A third plurality of LEDs may be arranged on the second side. The third plurality of LEDs may be arranged on the second side in a similar way as the first plurality of LEDs 613 is arranged on the first side 615. The third plurality of LEDs may be covered with an encapsulant like the encapsulant 614. The second side of the first LED filament 610 may also be covered/encapsulated by an encapsulant, such as the encapsulant 614.

Further, the second LED filament 620 may comprise a second side which is opposite to the first side 625. A fourth plurality of LEDs may be arranged on the second side. The fourth plurality of LEDs may be arranged on the second side in a similar way as the first plurality of LEDs 623 is arranged on the first side 625. The fourth plurality of LEDs may be covered with an encapsulant like the encapsulant 624. The second side of the second LED filament 620 may also be covered/encapsulated by an encapsulant, such as the encapsulant 624.

Figure 7:
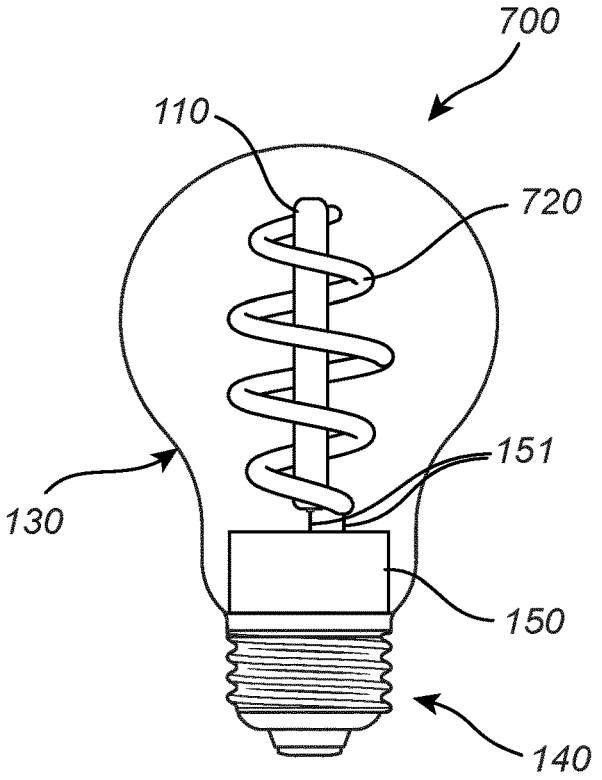
FIG. 7 shows a schematic illustration of a lighting device in accordance with some embodiments.

With reference to FIG. 7, a lighting device in accordance with some embodiments will be described.

FIG. 7 shows an embodiment of a lighting device 700. The lighting device 700 may be equivalent to the lighting device 100, except that the second LED filament 720 is curved differently, defining a different volume. Specifically, the second LED filament 720 has a helical shape which has a diameter that is wider at the middle and tapers towards the ends, such that the volume which is at least partially defined by the second LED filament 720 may be described as a bicone. In other words, the diameter of the turns of the cylinder increases from the first turn/loop to the middle turn/loop, then the diameter decreases from the middle loop to the final loop. Thus, the first and last turns have smaller diameters than the intermediate turns/loops.

Figure 8:
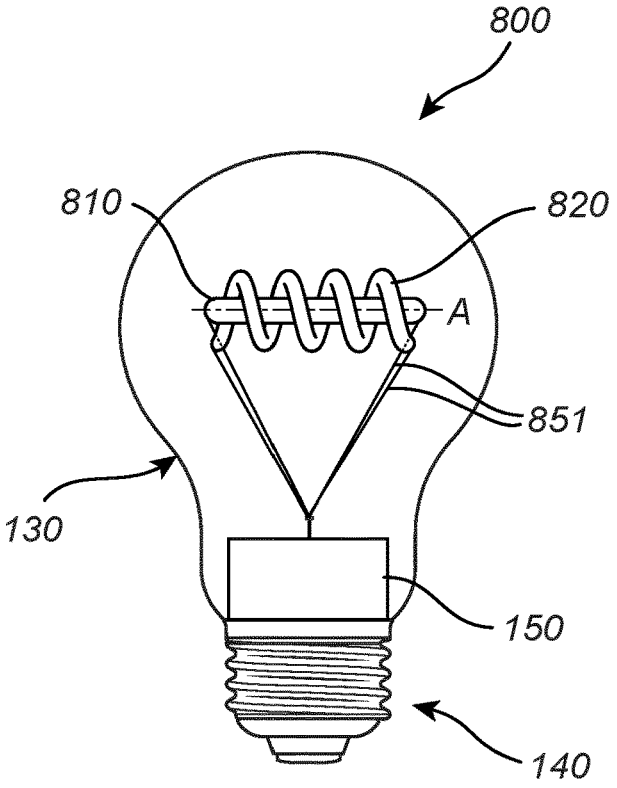
FIG. 8 is a schematic illustration of a lighting device in accordance with some embodiments.

With reference to FIG. 8, a lighting device in accordance with some embodiments will be described.

FIG. 8 shows an embodiment of a lighting device 800. The lighting device 800 may be equivalent to the lighting device 100, except that the first LED filament 810 and the second LED filament 820 are arranged with a different orientation within the envelope 130.

As the lighting device 100 in FIG. 1, the lighting device 800 of the present embodiment comprises an at least partially light-transmissive envelope 130 which is mounted on a base 140, and a controller 150. The base 140 defines a plane on which the controller 150 is arranged.

In the present embodiment, the second LED filament 820 forms a helix shape defining a cylindrical volume. The second LED filament 820 is arranged within the envelope such that the central axis A of the cylindrical volume, defined at least in part by the second LED filament 820, extends substantially parallel to the plane defined by the base 140, instead of extending away (at an angle) from the base (as shown in FIG. 1). The first LED filament 810 is arranged along the central axis A of the volume defined (at least in part) by the second LED filament 820. Connectors 851 connect the LED filaments 810, 820 to the controller 150.

The person skilled in the art realizes that the present invention by no means is limited to the preferred embodiments described above. On the contrary, many modifications and variations are possible within the scope of the appended claims.

Although features and elements are described above in particular combinations, each feature or element can be used alone without the other features and elements or in various combinations with or without other features and elements.

Additionally, variations to the disclosed embodiments can be understood and effected by the skilled person in practicing the claimed invention, from a study of the drawings, the disclosure, and the appended claims. In the claims, the word "comprising" does not exclude other elements, and the indefinite articles "a" and "an" do not exclude a plurality. The mere fact that certain features are recited in mutually different dependent claims does not indicate that a combination of these features cannot be used to advantage.

The invention claimed is:

1. A lighting device comprising:

a first elongated light-emitting diode, LED, filament;

a second elongated LED filament;

an at least partially light-transmissive envelope at least partially enveloping at least said first LED filament and said second LED filament; and a base on which said at least partly light-transmissive envelope is mounted;

wherein said first LED filament is configured to emit light with a different color temperature than said second LED filament;

wherein said second LED filament is at least partially curved such that it defines at least part of a contour of a volume; and wherein said first LED filament is arranged at least partially within said volume, wherein said first LED filament has a first LED filament length and said second LED filament has a second LED filament length, and wherein said second LED filament length is more than twice as long as said first LED filament length, wherein said first LED filament is arranged along a central axis of said volume and said second LED filament forms a helix shape.

2. The lighting device of claim 1, wherein said first LED filament is adapted to emit light with a higher color temperature than said second LED filament.

3. The lighting device of claim 1, wherein the first LED filament is configured to emit light with a color temperature which is higher than 2700 K.

4. The lighting device of claim 1, wherein the second LED filament is configured to emit light with a color temperature which is lower than 2500 K.

5. The lighting device of claim 1, wherein said first LED filament has a larger diameter than said second LED filament.

6. The lighting device of claim 5, wherein said first LED filament has a first LED filament diameter and said second LED filament has a second LED filament diameter, and wherein said first LED filament diameter is more than twice as large as said second LED filament diameter.

7. The lighting device of claim 1, wherein said first LED filament is substantially straight or less curved than said second LED filament.

8. The lighting device of claim 1, further comprising a controller configured to control a power supplied to said first LED filament and a power supplied to said second LED filament.

9. The lighting device of claim 1, wherein said first LED filament and said second LED filament comprise LEDs configured to emit light with a peak wavelength in the range 365-380 nm and/or in the range 435-500 nm.

10. The lighting device of claim 1, wherein said first LED filament comprises:

a first substrate having a first side on which a first plurality of LEDs is arranged; and a first encapsulant at least partially encapsulating said first side of said first substrate and said first plurality of LEDs; and wherein said second LED filament comprises:

a second substrate having a first side on which a second plurality of LEDs is arranged; and a second encapsulant at least partially encapsulating said first side of said second substrate and said second plurality of LEDs.

11. The lighting device of claim 10, wherein said first encapsulant comprises a first wavelength converting material, and wherein said second encapsulant comprises a second wavelength converting material.

* * * * *